United States Patent [19]

Jelinek et al.

[11] Patent Number: 4,703,925

[45] Date of Patent: Nov. 3, 1987

[54] SEMI-RIGID SHEET SEPARATION DEVICE AND METHOD

[75] Inventors: Ross R. Jelinek, North Tonawanda; Robert R. Fraas, Akron; Richard M. Stein, Lancaster; Lewis G. James, Clarence, all of N.Y.

[73] Assignee: Strippit/Di-Acro-Houdaille, Inc., Akron, N.Y.

[21] Appl. No.: 761,318

[22] Filed: Aug. 1, 1985

Related U.S. Application Data

[63] Continuation-in-part of Ser. No. 699,950, Feb. 8, 1985, abandoned.

[51] Int. Cl.[4] ..... B65H 3/08

[52] U.S. Cl. ..... 271/11; 271/14; 271/91; 271/103; 271/106

[58] Field of Search ..... 271/11, 12, 13, 14, 271/19, 15, 91, 94, 95, 102, 106, 107, 108, 90, 103, 104, 105, 265, 267

[56] References Cited

U.S. PATENT DOCUMENTS

| | | | |
|---|---|---|---|
| 2,936,171 | 5/1960 | Williams | 271/12 |
| 3,826,485 | 7/1974 | Shindo | 271/106 |
| 3,830,121 | 8/1974 | Makeev et al. | 83/81 |
| 3,966,197 | 6/1976 | Riedl et al. | 271/103 X |
| 3,980,293 | 9/1976 | Shelmire | 271/106 X |

FOREIGN PATENT DOCUMENTS

| | | | |
|---|---|---|---|
| 0061543 | 5/1980 | Japan | 271/91 |
| 0061542 | 5/1980 | Japan | 271/91 |
| 1168312 | 10/1969 | United Kingdom | 271/90 |

OTHER PUBLICATIONS

Aycock et al., "Feed Mechanism for Printed Circuit Boards", *Western Electric Technical Digest,* No. 26, 4/1972, pp. 3–4.

*Primary Examiner*—Duane A. Reger
*Assistant Examiner*—Matthew C. Graham
*Attorney, Agent, or Firm*—Hill, Van Santen, Steadman & Simpson

[57] ABSTRACT

A method and apparatus for ensuring sheet separation of a single sheet workpiece from a stack of workpiece sheets which consists of a lifting assembly having at least three spaced sets of sheet workpiece holding suction members with at least a poriton of one set being reciprocatable in a vertical movement to cause flexure of a sheet being raised by the lifting device to cause separation of an underlying sheet which may have adhered to the sheet being lifted.

24 Claims, 16 Drawing Figures

SEMI-RIGID SHEET SEPARATION DEVICE AND METHOD

This is a continuation-in-part of application Ser. No. 699,950, filed Feb. 8, 1985, now abandoned.

BACKGROUND OF THE INVENTION

1. Field of the Invention

This invention relates to machine tools and more particularly to a sheet workpiece separation and feed device and method of sheet separation.

2. Prior Art

Recent developments in production engineering have emphasized the development of production process automation, utilizing unattended operation of production machines. Central to this concept is the use of computer controlled machines which are automatically supplied with workpieces by feeder mechanisms which are also under computer control. Although movement between successive machines can be accomplished in any of a number of various ways, common to such "automated factory" concepts is the necessity of supplying of an initial workpiece from a group of similar workpieces. Although this is principally a step to be performed at the initial stage of any production process, it also frequently repeats itself at various in-process storage points along the production flow.

When working with sheet material such as, for example, sheet metal or sheets of plastic or wood, there is a defined stage which is frequently encountered. This is a point where a stack of substantially similar sheets exists and where the sheets must be fed one at a time from the stack to a machine. This may occur initially at a point where the raw material sheets are being fed to the first production machine or it may occur at repeated points thereafter where partially worked sheets are stacked in holding areas between machines.

Automatic devices for supplying a sheet from a stack of sheets to a machine are well known. One particularly often used loader system in the machine tool industry which is utilized for supplying sheet material to fabricating equipment, such as punch presses, shears, blanking machines and the like, utilizes a top feed concept where the top sheet of a stack of sheets positioned in a storage area is lifted from the stack by a suction device and is thereafter transported by that device to a machine tool or machine tool group. An example of such a device is shown in U.S. Pat. No. 3,830,121 entitled "Installation for Cutting Rolled Sheets", issued Aug. 20, 1974. That patent illustrates a sheet feed mechanism for feeding a guillotine shear, the sheet feed mechanism including a swingable transfer arm from which vertically movable suction cups are suspended. The transfer arm initially positions the suction cups over a storage area where the cups are lowered onto the top sheet of the stack received in the storage area. After suction is applied, the suction cup set is lifted, thus lifting the top sheet. The swing arm then swings the suction set to a position over a feed mechanism. The suction set then lowers the sheet to the feed mechanism and the suction is terminated.

Another type of device, particularly adapted for use in connection with an auto gauging system which automatically gauges the sheet at the feed device, is shown in Canadian Pat. No. 1,077,387, issued May 13, 1980, and its counterpart United States patent application Ser. No. 52,241, filed June 26, 1979 as a continuation of U.S. Ser. No. 815,821, filed July 15, 1977, entitled "Automatic Load Unload Turret Punch", inventor Stephen C. Clark, all of which are assigned to the assignee of this application. Since the invention of the present application is usable in the device of the Clark U.S. application and Canadian patent, it will be described in connection therewith. For a more complete discussion of the loader mechanism, the teachings of the Clark application and patent are herein incorporated.

A common problem encountered with such suction lift and transfer devices when used in connection with sheet materials is the adherence of an underlying sheet to the top sheet. Since the suction operates only on the top sheet, except in those instances where slightly air pervious materials might be used as sheet material, the adherence of an underlying sheet is not caused by the application of the suction but rather by an underpressure or vacuum condition which may develop between the stacked sheets and which is particularly aggravated where fluids are applied to the sheets. It is common, particularly in connection with metals, for a lubricant or a preservative, or a combination of lubricant and preservative, to be applied to the sheets during their processing prior to stacking. This lubricant can be advantageous in the further processing of the sheet reducing friction as the sheet is worked on by the machine tools. However, it is a disadvantage when attempting to separate sheets, causing an underlying sheet or even sheets to adhere to or move with the sheet being lifted by the suction device.

Where magnetic materials are being worked on, it has been known to equip the transfer mechanism with separating devices known as fanning magnets, however, such magnets have little or no effect on non-ferrous materials such as, for example, aluminum, plastic, etc.

It would therefore be a noticable advance in the art to provide a non-magnetic system and method for assuring sheet separation in suction loading of workpiece sheets for supply to machine tools.

SUMMARY OF THE INVENTION

This invention overcomes the problems of sheet separation encountered in prior art pneumatic sheet loading devices. The problem is solved by causing a top sheet to undergo a vertical flexure to generate a gap between the top sheet and any underlying sheets adhering to the top sheet.

In a preferred embodiment, the sheet lifting and transfer device includes a carriage mechanism from which a head is suspended, which head is vertically movable with respect to the carriage. A group of pneumatic suction cups are suspended from the head with the cups spaced apart from one another. In the preferred embodiment, at least three groups of cups are positioned along the length of the head with all but an endmost one of the groups consisting of at least two cups spaced transverse of the head. The endmost group, which may consist of one or a plurality of cups, is affixed to the head in a manner which allows independent vertical movement of the endmost group with respect to the head.

When the head is lowered from above the stack of sheets, the cups of each group are brought into contact with the top surface of the top sheet. Thereafter, a vacuum is applied to the cups, causing the top sheet to be gripped by the suction cups. The endmost group of suction cups is raised to cause a corresponding edge portion of the top sheet to flex upwardly. The head is then lifted to elevate the top sheet and any underlying sheets which are adhering to the top sheet above the remainder of the stack. Fanning magnets may be employed at this time to separate ferrous underlying sheets or may be dispensed with entirely in view of the separating capability of this invention. After the head has moved for at least a portion of its vertical movement distance above the stack, the head is stopped. An air jet directs a stream of air at an edge of the flexed portion of the sheets. In the preferred embodiment, the stream of air is shaped by the jet into a vertically oriented flat fan shape so that air flows both above and below the flexed sheets. While the stream of air is impinging the flexed edge of the sheets, the endmost group of suction cups are lowered to their original position substantially in the plane of the other suction cup groups. The shear forces between the sheets created by the flexing of the sheets generally initiates an air gap between the top sheet and any adhering sheets which air gap is propagated by the air jet. As the gap between the top sheet and the underlying sheets increases, the sheets separate and the underlying sheets fall onto the stack from which they were lifted.

In a second embodiment, the outboard groups of suction cups are fixed relative to the head, and a center group of cups is vertically movable. In the same manner as described above, the head is lowered onto a stack of sheet material and the top sheet, and any adhering sheets, are lifted from the stack. The center group of cups is thereafter vertically oscillated with respect to the head while the outboard groups of cups remain at a given position. The effect of this is to cause the central portion of the gripped sheet workpiece to flex with respect to the outboard portions of the sheet. This vertical oscillation or flexure of the central portion of the sheet gripped by the central group is maintained for a period of time and preferably consists of both up and down flexure movements.

Since the flexure movement is applied to the top sheet by movement of the central group of suction cups while the outboard portions of the top sheet are retained by the outboard cups, the gripped sheet is forced to undergo positive and negative bowing. Since at the same time the only force acting on an underlying sheet adhering to the top sheet is the adhesion force between the sheets generally attributable to a low pressure or vacuum condition between the sheets, it is to be expected that gaps will occur between the two sheets. As such gaps are formed, the underpressure condition between the sheets will be eliminated and the bottom sheet will fall away from the oscillating top sheet. An air jet may also be used in the second embodiment directed at an edge of the flexing sheets.

In the second embodiment illustrated herein, the central group has three vertical positions. In the first position, intermediate the other two positions, the suction cup(s) of the central group lies along a plane including the cups of the other two groups. A second position of the central group positions the cup(s) of that group below that plane and a third position positions the cup(s) of the central group above that plane. The cup(s) is/are positioned at the first position except when undergoing sheet separation oscillations, during which time it is cycled between the second and third positions, thereby causing both positive and negative bowing of the gripped sheet.

Either embodiment of the present sheet separation system can be used in association with a sheet thickness feeler or gauge. The feeler may include a horizontally moveable component for moving the feeler gauge towards and away from an edge of the lifted sheets and a vertically movable component for moving at least one feeler surface relative to a second feeler surface, together with electronic means for sensing the relative position of the feeler surfaces, whereby the presence or absence of a second sheet adhereing to the top sheet can be detected.

This feeler gauge can be integrated in its operation with the control of the separation device and the overall destacker and loading device.

It is therefore a principal object of this invention to provide an improved method and apparatus for separating sheet material.

It is another, specific object of this invention to provide an improved method and apparatus for separating large size sheet material from a stack of sheet material being infed to a machine tool.

It is another and specific object of this invention to provide a sheet material de-stacker and loading device for use in separating sheets of workpieces from a stack of large sheets of workpieces and infeeding them to a machine tool, the device being equipped with a mechanism for insuring sheet separation whereby only a single sheet will be de-stacked and loaded to the machine tool, the sheet separation device including an oscillating (reciprocating) member which causes flexure of a gripped sheet.

It is another particular object of this invention to provide a sheet separating device which is used in connection with a suction cup sheet de-stacker employing a plurality of suction cups, the separation device including means for vertically oscillating at least one of the suction cups to cause a sheet held in the suction cups to undergo a vertical bowing movement.

It is another object of this invention to provide a sheet destacker and loading device utilizing suction cups for lifting a top sheet from a stack of large worksheets being infed to a machine tool and having a feeler gauge to sense the presence of one or more sheets being held by the suction cups and an oscillating mechanism for oscillating at least one of the suction cups to cause a sheet held by the suction cups to undergo a vertical bending movement about its central portion to cause adhering underlying sheets to drop away.

It is a further object of this invention to provide a sheet separating device for removing top sheets one at a time from a stack of similar sheets where the top sheet undergoes flexing to initiate a gap between it and any underlying sheets adhering to it. An air jet directed at an edge of the flexed portion propagates the gap so that the underlying sheets loosen from the top sheet.

Other objects, features and advantages of the invention will be readily apparent from the following description of several embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
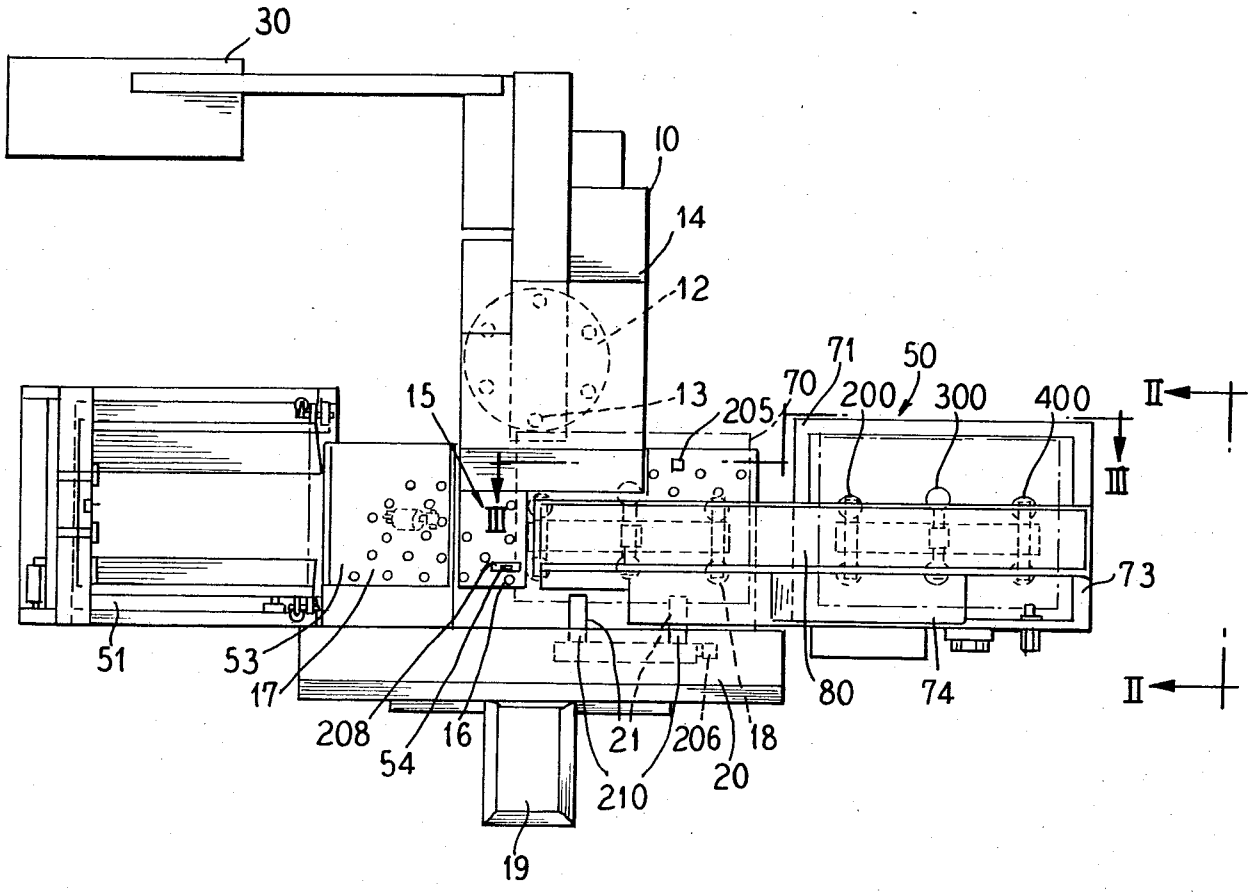
FIG. 1 is a top plan view of an automatic punch press equipped with a loader device according to this invention.
Figure 2:
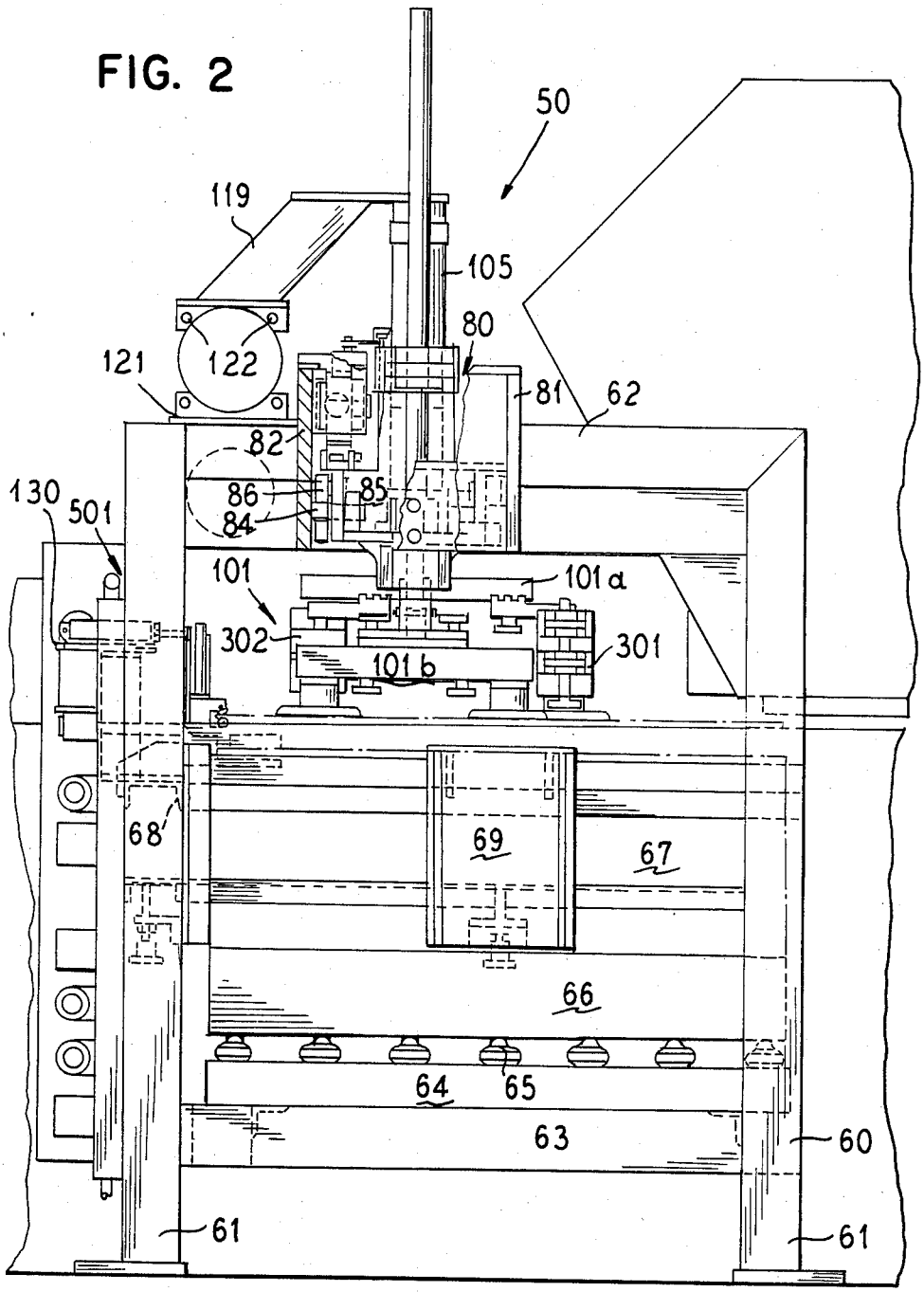
FIG. 2 is an end elevational view taken along the lines II—II of FIG. 1.
Figure 3:
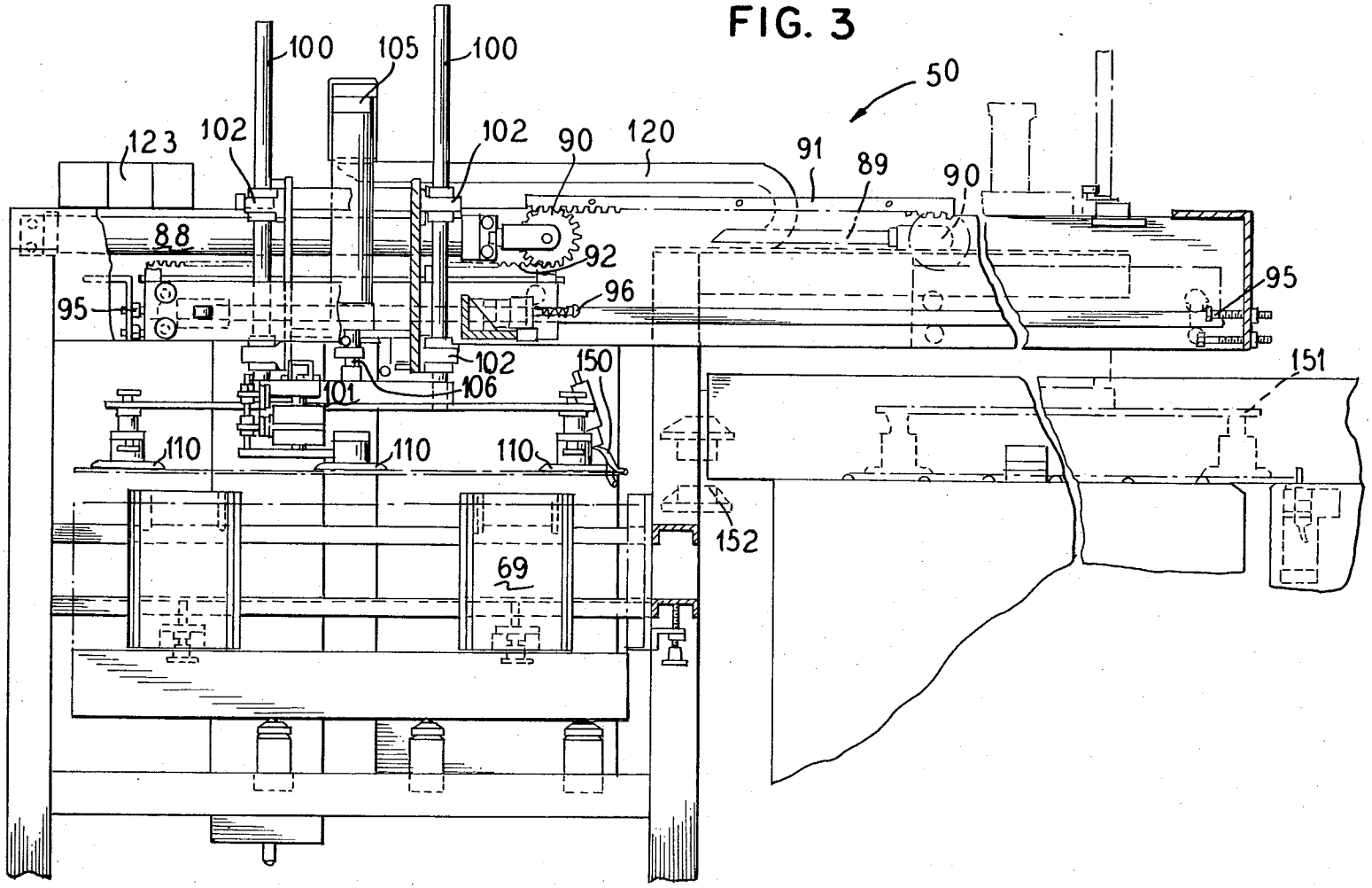
FIG. 3 is a side elevational view taken along the lines III—III of FIG. 1.

FIGS. 1, 2 and 3 are substantially similar to FIGS. 1, 2 and 3 of the aforementioned Clark application and Canadian patent, and are provided to show a typical environment in which the present invention can be practiced. It will be appreciated that the present invention is useful in connection with a wide variety of different specifically engineered sheet de-stacker and loader devices utilizing vertical lift suction systems and that, to this end, FIGS. 1, 2 and 3 are provided for the sole purpose of illustrating a typical sheet de-stacker loader device employing vertical lift suction cups. The following description of FIGS. 1, 2 and 3 is taken from the aforementioned Clark application.

As illustrated in FIG. 1, the loader device is adapted for use in association with machine tools and more particularly with punch machines 10. Such punch machines 10 comprise a punching station and include lower and upper spaced apart tool holding members 12 containing, respectively, dies and punches with the tool holding members 12 being exchangeable to present any given set of punch and die at a work station 13. Positioned in front of a tool carrying assembly housing 14 is an elevated work table 15 which includes a stationary central portion 16 and in and out movable table portions 17 and 18. Movement of the table portions 17 and 18 is controlled by a motorized lead screw 19. A horizontally movable gripping carriage 20 is carried by the work table portions 17 and 18 for movement therewith. The carriage 20 carries horizontally movable workpiece clamping means in the form of gripping members 21.

As is well known to the art, movement of the workpiece gripping members 21, the moving work table portions 17, 18 and the selection of tools in the tool carrier 12 and pesentment of the tools to the work station 13 is all controlled by a control means 30 which may be an NC, a punch tape reader, or computer.

The particular control 30 utilized in association with this invention forms no part of the invention and standard available controllers may be utilized. It is apparent that any person skilled in the art of designing machine tool controls will be able to provide control hardware and software to effectuate control of the devices as hereinafter described and therefore no attempt will be made to describe the construction of the control or of the particular programming to be utilized in association with the control. Moreover, although certain switches, valves, cylinders, etc., may hereinafter be mentioned, it will be appreciated that the selection of appropriate ones of such devices can readily be left to persons of ordinary skill in the art and that, in fact, the utilization of any particular form of control, pneumatic, electronic or hydraulic portions of the invention can be left to the discretion of the machine designer to be determined by various factors including, inter alia, the particular machine in connection with which the device is intended to be used, the enivronment in which the machine will be placed and controls already available for that environment. For example, the use of a dedicated control, such as the control 30, is not necessary and a single central control or a system of networked controls may be utilized if desired.

In the practice of this invention, an automatic workpiece loading device or magazine 50 is positioned adjacent one side of the work table 15 and a workpiece stacking device or unload magazine 51 is positioned adjacent the other side of the work table 15. The side of the table associated with the unloading stacking device 51 is equipped with a tipping edge section 53 of the type described in U.S. Pat. No. 4,080,855.

Additionally, the machine tool 10 is provided with an automatic side gauge mechanism 54, the side gauge 54 including a switch 208 which senses the side edge position of a workpiece as the workpiece is moved towards the side gauge 54 by the grippers 21. Further, the grippers 21 are provided with pressure sensing switches 210 and the carriage 20 is provided with an X-axis gripping carriage position sensing switch 206 while the moving table portion 18 is provided with a Y-axis position sensing switch 205 which may, for example, be actuated by a cam land on a base underlying the moving table portion 18. A sensing switch (not shown) is also positioned adjacent a tip table section 53 and is effective to sense when the tip table 53 is in the tipped condition.

As best shown in FIGS. 2 and 3, the workpiece loading device 50 comprises a frame 60, including spaced uprights 61 capped by top rails 62 and supporting bottom rails 63. The bottom rails 63 are equipped with bed members 64 having anti-friction means 65 thereon for receipt of a pallet 66 containing a stack 67 of workpiece sheets. If desired, a pad may be interposed between the anti-friction means 65 and the pallet 66, which will raise the pallet 66 and thus adjust the volume of the loading magazine 50. Two sides of the frame enclosed area carry spaced parallel rails 68 on which are adjustably positioned sheet fanning magnets 69 for separating ferrous sheets.

In order to provide adequate access to a corner 70 of the machine tool 10 as shown in FIG. 1, a corner 71 of the frame 60 has the side upright 60 extending only partway up. Thus, the top rail 62 extends fully only on sides 73 and 74. Extending crosswise of the lower frame 60 and cantilevered out over the table 15 of the machine tool 10 is a carriage track 80 as shown in FIG. 1 including parallel walls 81 and 82 welded to the top rail 62 which parallel walls 81 and 82 internally support inwardly projecting track pieces 84 on which a carriage 85 is mounted by means of rollers 86 such that the carriage 85 is movable along the length of the carriage track 80 from a position over the stack 67 to a position overlying approximately half the machine tool workpiece support table 15.

The carriage 85 is power moved by a double acting cylinder 88 shown in FIG. 3 having a power arm 89 terminating in a rotatable pinion 90. A fixed rack 91 carried by wall 82 overlies the pinion 90 and extends partway along the length of the carriage track 80. A moving rack 92 underlies the pinion 90 and is affixed to the carriage 85. Thus, actuation of the cylinder 88 to extend the power arm 89 will cause movement of the carriage 85 in the direction of movement of the power arm 89 with carriage movement being twice the power arm movement. Adjustable stops 95 at both ends of the tracks 84 cooperate with shock absorbers 96 affixed to the carriage 85 to limit movement of the carriage 85 at the ends of the carriage track 80.

The carriage 85 has linear motion bushings 102 attached thereto through which parallel vertically supported bushing rods 100 project. Rods 100 are affixed to a head member 101 positioned below the carrier 85 and movable therewith. A double acting cylinder 105 carried by the carriage 85 has a power arm 106 attached to the head 101.

A plurality of pneumatic cups 110 are attached to and depend from the head 101 overlying the stack 67 when the carriage 85 is in the position illustrated in FIGS. 2 and 3.

Hydraulic and electric power can be supplied to the carriage 85 and the head 101 through a channel 119 affixed to cylinder 105 and movable therewith. The channel 119 is attached to a hairpin shaped self-laid down cat track 120 supported on a shelf 121 paralleling the carriage track 80. The cat track 120 has electric and hydraulic conduits 122 extending therethrough, some of which are connected to a vacuum pump assembly 123 mounted atop the frame 60. A control panel 130 is also mounted to the frame 60.

In general, such a device can be assumed to operate in the following manner. With the carriage 85 positioned as shown in FIGS. 2 and 3 and the head 101 overlying the stack 67 of individual sheet workpieces, cylinder 105 is actuated to extend the power arm 106 to lower the head 101 towards the stack 67. A sensing device, such as sensing device 150, can be used to sense when the cups 110 are in engagement with the top sheet S of the stack 67 and to trigger suction application to the cups 110. Thereafter, the cylinder 105 is reversed to raise the power arm 106 to the elevated position as shown in FIG. 3. Thereafter, the cylinder 88 is actuated to advance the carriage 85 along the carriage track 80 to a deposit position illustrated at 151 of FIG. 3. At that point, the cylinder 88 is stopped and cylinder 105 is actuated to lower the head 101 and the cups 110 and suspended workpiece S. Sensing means can be employed if desired to determine when the workpiece S has been deposited on the machine tool workpiece support table 15. Thereafter, suction is discontinued to the cups 110, and the loading and transfer device, including the head 101, can be operated in reverse sequence to return it to the initial position of FIG. 3.

As will be appreciated, many auxilliary sensors and controls can be employed, such as, for example, a sheet sensing device 152, which assures that the sheet S is being carried by the cups 110 during transport of the sheet S from the stack area 67 to the unload area, pressure regulators regulating control of vacuum pressure in the cups 110, actuation controls for actuating the fanning magnets 69, height adjust movement systems for moving the bed 64 up and down so that the stack height remains within reach of the extended power arm 106 of the cylinder 105, air blast off systems to assure positive release of the sheet S in the unload or deposit area, etc.

It will be understood that all of these functions are or can be controlled from a common control source equipped with adequate safety checks, etc.

Since the actual construction of the de-stacker and loading transfer mechanism 50 does not form a part of this invention, no further attempt will be made to describe this device except in those areas where the present invention shows modification of standard de-stackers.

As best illustrated in FIG. 2, the head assembly 101 may consist of upper **101*a* and lower 101*b* cup mounting brackets. In the practice of this invention, the addition of the upper bracket 101*a* to the head 101** facilitates the additional height of a modification to certain of the cup assemblies.

As illustrated in FIG. 1, three groups, 200, 300, and 400, of cup sets are provided with the groups 200, 300 and 400 spaced along the length of the head assembly 101 in the direction of movement of the carriage 85. A greater number of groups may be provided, if desired. Each of the groups 200, 300 and 400 is provided with a pair of suction cups 110 extending from opposite sides of the head assembly 101 transverse the direction of movement of the carriage 85. In a first embodiment, center group 300 consists of cup assemblies 301 and 302 which are mounted from the upper head bracket **101*a*. The outboard groups 200 and 400 may be mounted from the lower head bracket 101*b*. The cup assemblies of each group 200, 300 and 400 terminate in standard suction cups 110** which may, for example, be actuated by a venturi air pressure system, or by direct coupling to a vacuum system.

Figure 4:
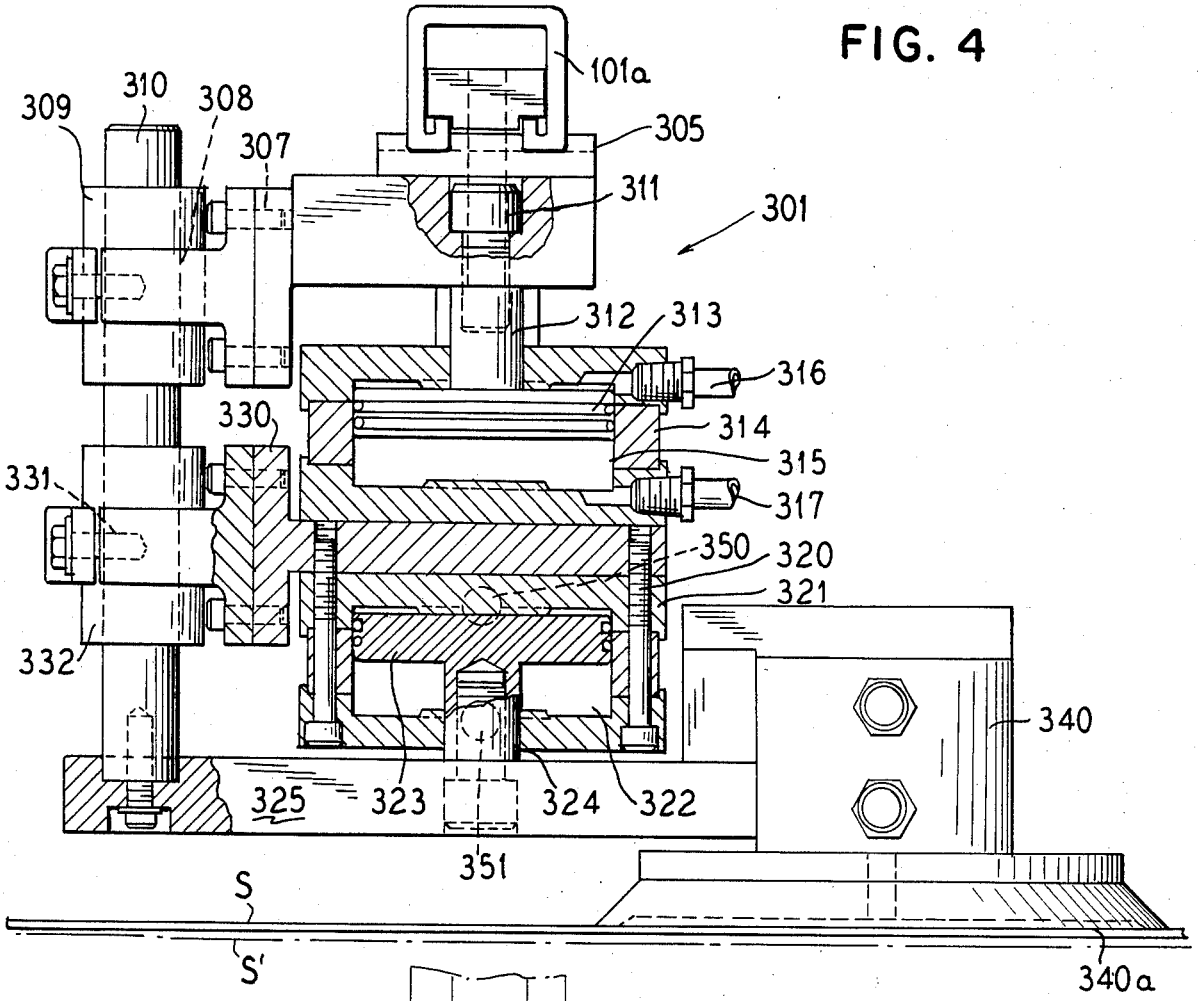
FIG. 4 is a partially sectional view of a sheet separator device according to this invention.
Figure 5:
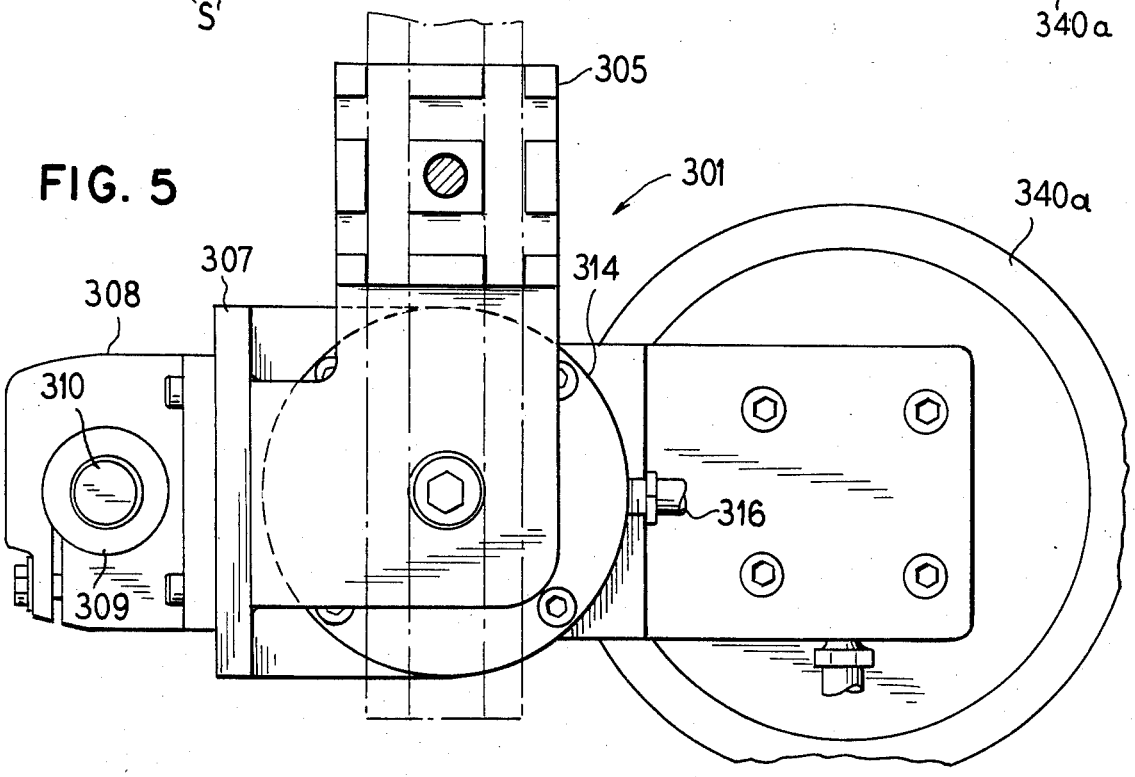
FIG. 5 is a top plan view of FIG. 4.
Figure 6:
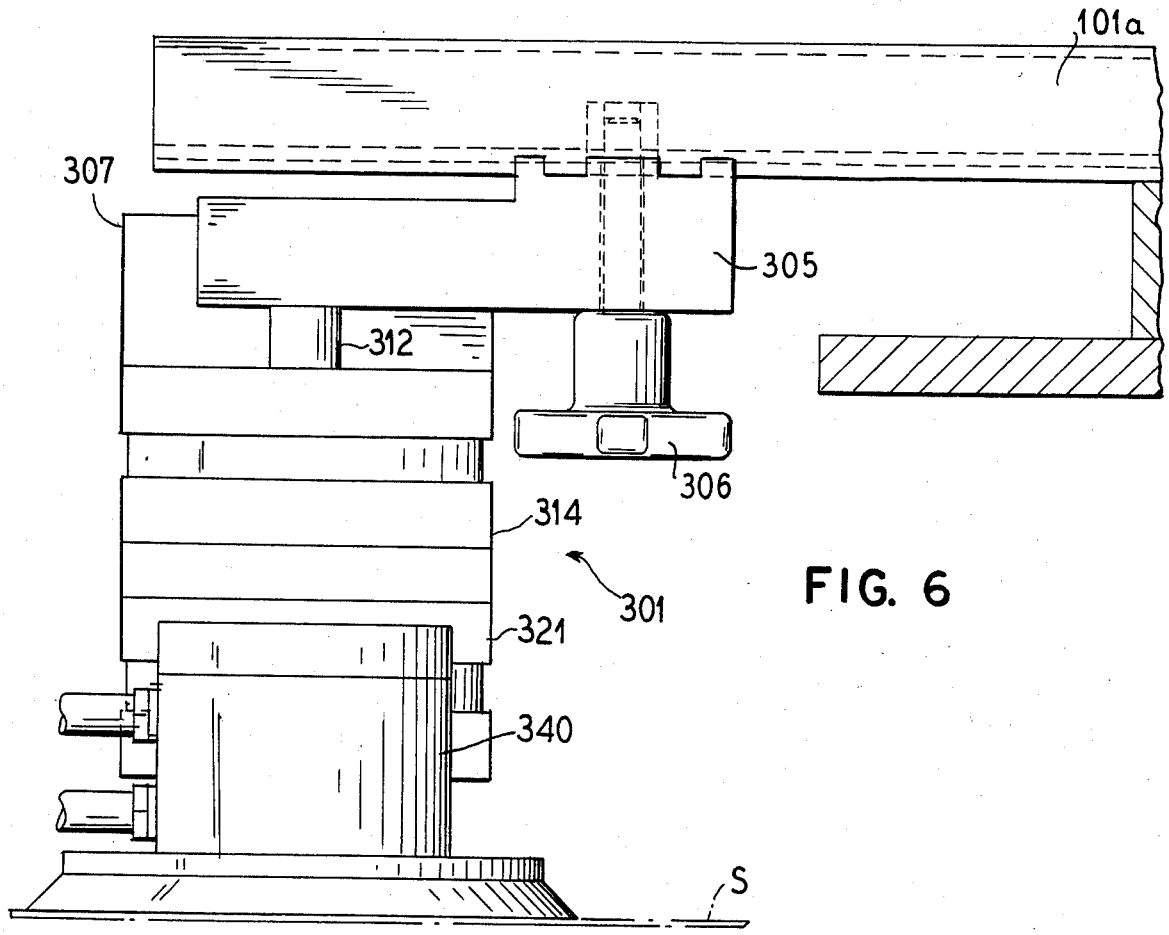
FIG. 6, on page 6 of the drawings, is a side view of the device of FIG. 4 substantially from the right hand side of FIG. 4.

As shown in FIGS. 4, 5 and 6, the group 300 cup assemblies 301 and 302 of the first embodiment, of which subassembly 301 is shown, include a mounting bracket 305 affixed to the upper head bracket **101*a* and adjustably positionable along the length of the bracket 305 by loosening and tightening of bolt 306. Affixed to the bracket 305 is a bracket member 307 which in turn carries a clamp bracket 308 clamped around a linear bushing 309 which slidably receives a guide rod 310. Also affixed to the bracket 305 via bolt 311 is a piston rod or power arm 312 of piston 313. The piston 313 is received in cylinder member 314 which defines cylinder 315. Pneumatic supply conduits 316 and 317 are provided for supplying pressure to either side of the piston 313 in the cylinder 315** under the control of valves (not shown) controlled by the central control.

The cylinder member 314 is attached by bolts 320 to bracket 330 as is cylinder member 321 by bolts (not shown). The cylinder member 321 defines cylinder 322 which receives piston 323. A piston rod or power arm 324 of the piston 323 projects from the cylinder member 321 and is affixed to bracket 325.

The dual cylinder assembly consisting of the cylinder defining member 314 and the cylinder defining member 321 are in turn fixed to bracket 330 which carries clamp bracket 331 which clampingly receives linear bushing 332 through which guide rod 310 also slidably projects, the bushing 332 being aligned with the bushing 309. One end of the guide rod 310 is affixed to bracket 325. It will be appreciated that the guide rod 310 assures horizontal stability of the cylinder assembly and proper movement of the bracket 325.

Suction cup subassembly 340 is attached to and carried by the bracket 325. The suction cup assembly 340 will not be particularly described since it can be any standard suction cup assembly of the general type above discussed.

The lower cylinder 322 also has pneumatic conduits 350 and 351 projecting through the cylinder wall supplying pressure above the piston 323 respectively or below the piston 323, again controlled by valves controlled by the central control.

With the pistons 313 and 323 positioned as shown in FIG. 4, the bottom 340*a* of the suction cup 110 of the group 300 will lie on the same plane as the bottom of the suction cups 110 from the groups 200 and 400 and will be in a position to contact the top sheet S of the stack 67 of sheet S when the head 101 is lowered. This position, which can be referred to the intermediate or neutral position, is utilized for lifting, transport and depositation of the workpiece sheet S.

However, in order to insure sheet separation, should a plurality of sheet S adhere during the lifting operation, the position of the cup assemblies 340 can be changed with respect to the position of the head bracket 101*a* which in turn is fixed with respect to the position of the head bracket 101*b*. Head bracket 101*b* is of course in fixed position with respect to the bottoms of the suction cups of groups 200 and 400.

Figure 10:
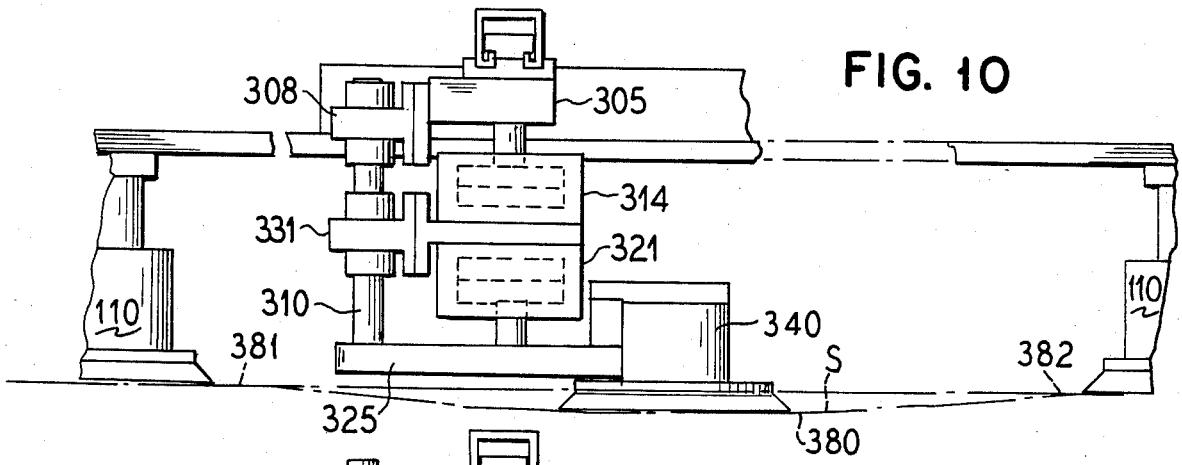
FIG. 10 on page 6 of the drawings is a diagrammatic view showing downward oscillation of the separator device of FIG. 4.
Figure 11:
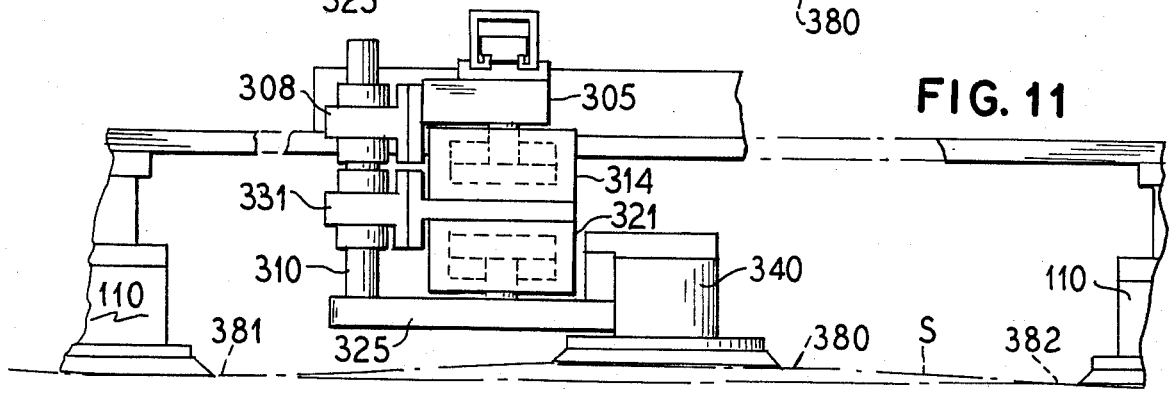
FIG. 11 is a view similar to FIG. 10 showing an upward oscillation movement.

By changing the position of the suction cup assemblies 340 of the first embodiment with respect to head bracket 101*a*, the sheet S carried by the three groups 200, 300 and 400 of the suction cups will be caused to undergo a bowing about its middle section. This is diagrammatically illustrated in FIGS. 10 and 11. In FIG. 10, pressure has been selectively applied to the requisite conduits 316, 317, 350 and 351, to cause the position of the suction cup 101 of suction cup assembly 340 to be extended below the neutral position thereby forcing a central section 380 of the work sheet S below outboard sections 381 and 382 which are retained by the suction cup assemblies 110 of respectively the groups 200 and 400. The reverse of this situation is illustrated in FIG. 11, where selective application of pressure to the cylinders 315 and 322 has caused the central section 380 of the workpiece W to be raised above the outboard sections 381 and 382. This oscillation back and forth between the position illustrated in FIG. 10 and the position illustrated in FIG. 11, each time passing through the neutral position of FIG. 4, will create shear forces between adhered double sheet S causing the bottom sheet to separate from the top sheet and to fall back into the stack. The top sheet of course is retained in position on the assembly due to the presence of suction in the suction cups 110.

In its simplest sequence then, a de-stacker and unloader assembly 50 according to this invention functions as follows: First the carriage assembly 85 is retracted to the position illustrated in FIG. 3 with the head assembly 101 positioned over a stack 67 of work sheet S. Thereafter, cylinder 105 would be actuated to lower the head assembly 101, which includes head brackets 101*a* and 101*b*, to a point where engagement between the suction cups 110 and a top work sheet S is sensed by means such as sensor 150. During this lowering operation, the suction cups 110 of group 200 would be in the neutral position of FIG. 4 so that the bottoms of all suction cups 110 are substantially aligned in a common plane. Upon sensing contact with the top workpieces, downward movement of the power arm 106 of the cylinder 105 would be terminated or, if preferred, a slight pressure could be retained on the power arm 106 to insure suction cup contact with the worksheet S . Thereafter, vacuum is applied to the cups 110. After sensing the presence of vacuum in the cups 110 by a sensor (not shown), the cylinder 105 is reversed to cause retraction of the power arm 106 thereby lifting the head 101 to an elevated position. The elevated position may be the full-up transport position for the carriage 85 or may be a temporary sheet separating position intermediate between the stack height position and the full up transport position. At that point, cyclic oscillation or reciprocation of the group 300 suction cup assemblies will be caused to occur by the appropriate application of pressure via the conduits 316, 317, 350 and 351, to move between the positions of FIGS. 10 and 11. This cyclic movement can be continued for a predetermined period at the conclusion of which the suction cup assemblies of group 300 will be returned to the neutral position of FIG. 4. The oscillation will have caused separation of any sheet S' adhering to the top sheet S. Thereafter, the head 101 can be moved to the transport height by further activation of the cylinder 105 or, if already at the transport height, be retained there. The worksheet S is now ready for transport to the machine tool 10 by activation of the cylinder 88. The sensor 152 can be used to sense that the sheet is properly present for transport. After transport to the appropriate deposit position on the work table 15, the head 101 can be again lowered by activation of the cylinder 105. Appropriate sensors can be employed to determined the proper depositing of the work sheet S including, for example, sensors associated with the cylinder 105. Thereafter, the vacuum can be terminated to the suction cups 110 and, if desired, a positive blow-off can be provided to the suction cups 110. The head 101 is then lifted and the carriage 85 is returned to the initial position over the stack 67 of workpieces and the machine tool 10 is activated to work on the sheet S.

Figure 7:
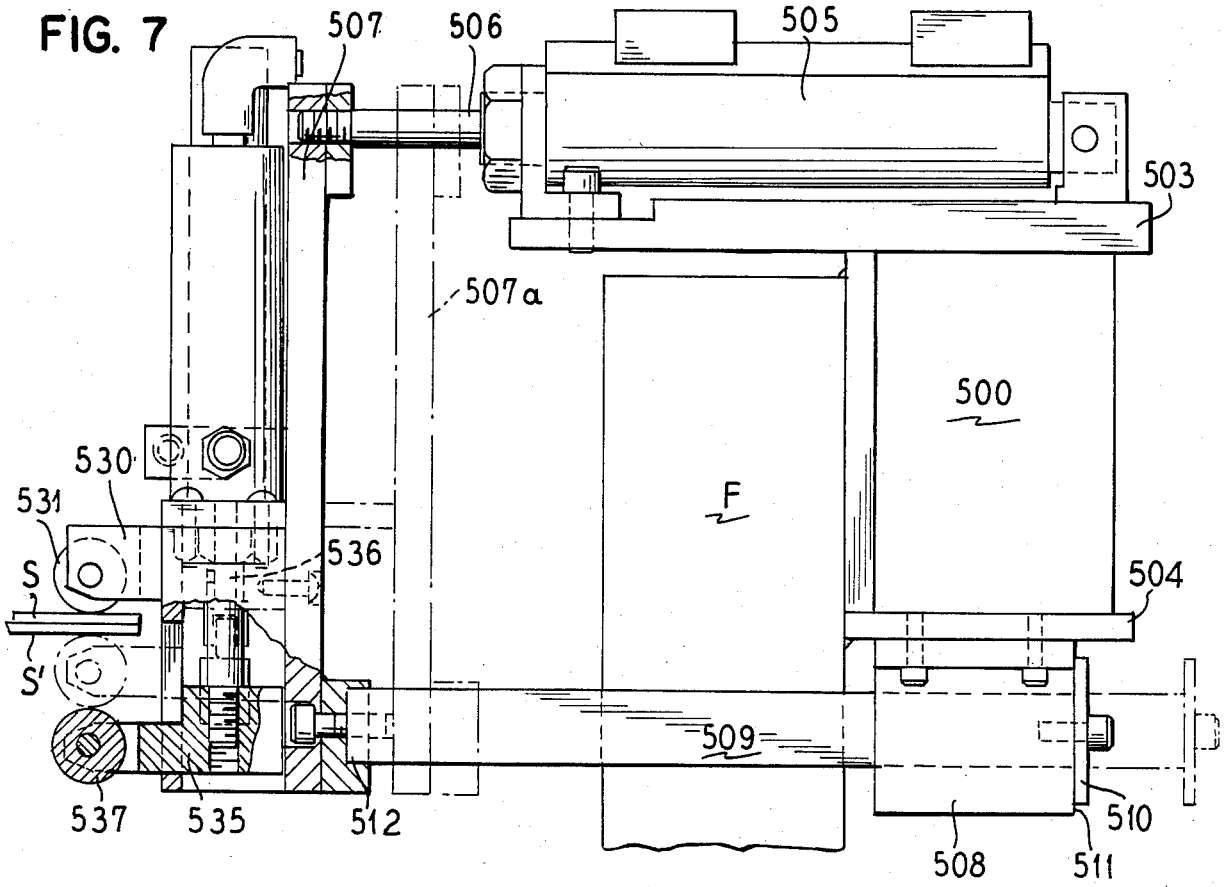
FIG. 7, on page 5 of the drawings, is a side elevational view, partially in section, of a feeler gauge device according to this invention.
Figure 8:
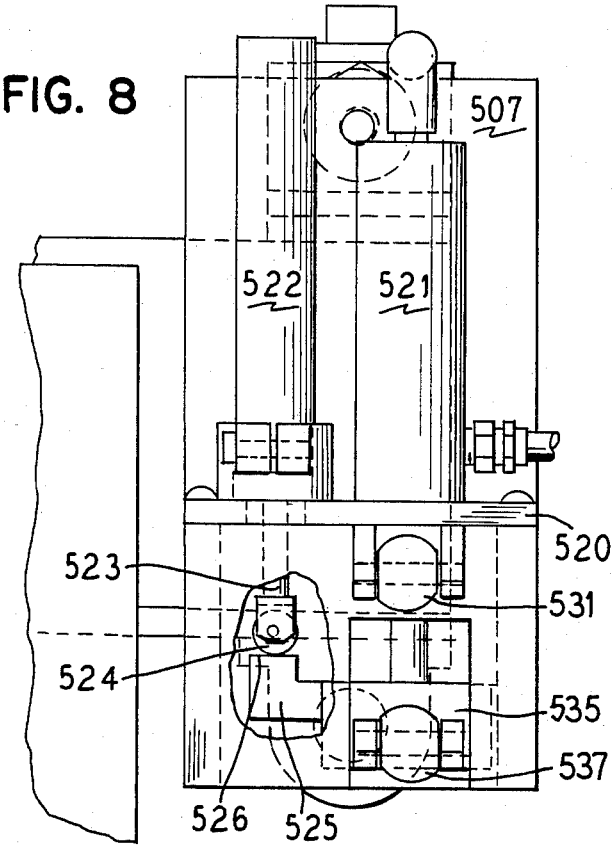
FIG. 8 is an end elevational view substantially from the left hand side of FIG. 7 of the feeler gauge device.
Figure 9:
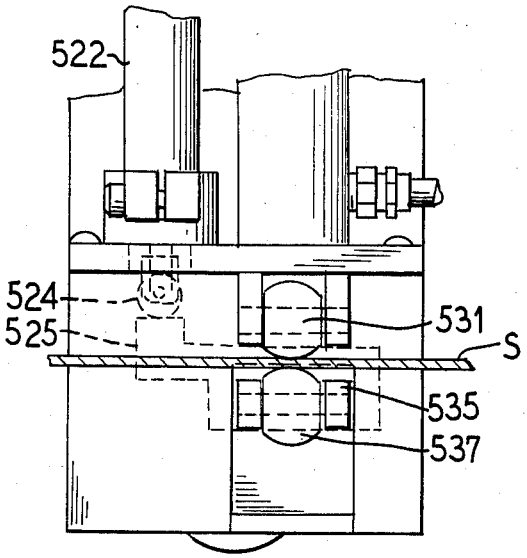
FIG. 9 is a view similar to FIG. 8 showing portions of the feeler gauge device in a sheet sensing position.

Alternatively, a feeler gauge 502 can be utilized to determine actuation of the group 300 oscillation cycles. As will be appreciated by those skilled in the art, the feeler gauge 502 or sheet sensor can be variously constructed. A preferred construction is illustrated in FIGS. 7 through 9 and consists of a base mounting bracket 500 which may, for example, be attached to the frame F of the loader such as, for example, at 501 of FIG. 2. The bracket 500 mounts a top bracket 503 and a bottom bracket 504. Attached to the top bracket 503 is a pneumatic cylinder 505 having an actuatable power arm 506 which in turn is fixed to bracket 507. Attached to the bracket 504 is a linear bushing 508 which receives guide rod 509, a free end of the guide rod 509 having attached thereto an adjustable abutment stop 510 adapted to engage an end 511 of the linear bushing 508 to limit linear movement of the rod 509 through the bushing 508. The other end of the rod 509 is affixed to the bracket 507 as at 512. It will thus be seen that actuation of the cylinder 505 to advance or retract the power arm 506 will cause the bracket 507 to be moved to the left or right in FIG. 7 with that movement being guided by the rod 509.

The bracket 507 has affixed thereto horizontal shelf 520 which supports pneumatic cylinder 521 and position sensor 522. The position sensor may be, for example, a linear position transducer, a potentiometer, etc. Extending outwardly to the left in FIG. 7 from the horizontal shelf 520 is a top finger 530 which terminates in a roller member 531. The feeler gauge assembly 502 is mounted to the frame F at a point where the bottom of the roller 531 will lie approximately on a plane which is coextensive with the bottoms of the suction cups 110 when the suction cups 110 are positioned by movement of the head 101 to a sensing position. The sensing position may either be the full up transfer position where the head 101 has been raised to its full height for transfer of carried sheet S to the machine tool 10 or, if desired, may be at some intermediate position below transfer position but above the projected top sheet position of a sheet line in a stack 67 of sheet S in the stack 67. In this manner, when the cylinder 505 is actuated to extend the bracket 507 to the left, as shown in FIG. 7, the roller 531 will overlie a sheet S carried by the suction cups 110. Since in some instances it can be expected that some sheet S will have edge position variances caused by warping or bending of the sheet S, it may be desired to mount the feeler assembly 502 at a level on the frame F where the roller 531 will lie slightly above the projected sheet top height.

The cylinder 521 has finger 535 affixed to a cylinder power arm 536 for vertical movement. The finger 535 has roller 537 attached to the end of the finger 535 underlying the roller 531 with the axes of the rollers 531 and 537 lying in substantially the same vertical plane. It can therefore be seen that actuation of the cylinder 521 will move the roller 537 towards and away from the roller 531. The stroke of the cylinder 521 is such that it is capable of causing the roller 537 to engage the roller 531 in the absence of any intervening sheet S.

The sensor 522 has a depending arm 523 which terminates in roller 524. Attached to the finger 535 is an abutment block 525 having a surface 526 in opposition to the roller 524. The arm 523 is biased downwardly so as to cause the roller 524 to engage the surface 526. Movement of the arm 536 of the cylinder 521 causes the finger 535 and the surface 526 to move vertically with the roller 524 maintaining biased engagement with the surface 526. The sensor 522 is of that class of sensors which can determine the extent of projection of the arm 523 and output a signal which is representative of the extent of projection of the arm 523 and which, therefore, in this embodiment, is representative of the distance between the rollers 531 and 537.

The feeler gauge 502 operates as follows: After the head 101 has been lowered such that the suction cups 110 have engaged the top of the stack 67, which may be sensed by sensor 150, and after suction has been applied to the suction cups 110 and the head 101 raised to either a sheet sensing position or to a transfer position, whichever may be employed, cylinder 505 is activated to urge the bracket 507 from a dotted line position 507*a* of FIG. 7 to a solid line position 507, at which time the rollers 531 and 537 will be positioned respectively above and below a sheet or sheets S carried by the suction cups 110. During the movement of the bracket 507 to the left as shown in FIG. 7, the roller 537 will be positioned at its maximum distance from the roller 531 by the cylinder 521 which, in the illustrated embodiment, is a double acting cylinder but which, if desired, may be a single acting spring biased cylinder biased towards a maximum projection of the arm 536. Thereafter, the cylinder 521 is actuated to draw the roller 537 toward the roller 531. The activation of the cylinder 521 is under a pressure bias which is sufficiently large to cause the sheet S between the rollers 531 and 537 to be lifted up and into contact with roller 531. Since the rollers 531 and 537 will be engaging edge portions of the sheet S beyond the suction cup contact, it can be anticipated that edge droop of the sheet S will be encountered such that the cylinder 521 should have sufficient strength to lift the sheet S up into contact with the roller 531. The sensor 522 is then employed to output a signal to the controller 30 which is indicative of the closest approach of the roller 537 to the roller 531. The signal can be constantly generated if desired or may be sampled at a time delay point after actuation of the cylinder 521. If desired, the time delay point can be integrated with a pressure sensor which senses a pressure build-up internally of the cylinder 521 indicative of a maximum pressure level. The maximum pressure level would equate to a point in time when the roller 537 is no longer moving, thus signifying that it has been moved to its closest possible position with respect to the roller 531.

It will of course be appreciated that those familiar with sensing equipment, and particularly with sensing equipment of the type described herein, can easily devise sequencing programs designed to input to a central controller 30 a signal from the sensor 522 at the proper time to signify the spacing between the rollers 531 and 537 at the desired time of measurement.

In the operation of this device, it is preferred that the central control 30 have previously inputted to it the anticipated thickness of the sheet S and whatever information is necessary for the signal from the sensor 522 to be correlated to the distance between the rollers 537 and 531. Thus, at the time of input of the signal, the control 30 will be able to determine whether (a) a sheet S is present and (b) whether more than one sheet S is present between the rollers 531 and 537.

Failure to sense the presence of a sheet S can be utilized to effect an all stop condition for the loader transporter 50 or, if desired, an automatic recyling of the steps of lowering the head 101, sensing engagement of a sheet S and activating suction to the cups 110 and lifting of the head 101 for remeasurement by the feeler gauge assembly 502. If the presence of more than one sheet S is sensed, then the cylinder 521 is activated to move roller 537 away from the roller 531 and the cylinder 505 is thereafter activated to withdraw the bracket 507 so that the fingers 530 and 535 and their associated rollers 531 and 537 are withdrawn from the edge of the sheet S. Thereafter, the sheet separating cycle is activated to oscillate the group 300 suction cup assemblies as previously described to cause sheet separation. Upon completion of the sheet separation cycle, the feeler gauge cycle can be repeated to determine if a sensed second sheet S′ has dropped away and to determine if a single sheet S is now present in the loader suction cup grip. This cycle of sensing sheets and activating the sheet separation cycle and resensing the sheet S can be repeated as many times as desired to insure that the adhering undesired sheet S′ has been separated, it being understood that after a certain number of repeats, it will become obvious that if the sheet S' has not separated, it is not going to do so automatically or a mistake has been made in the setting of the thickness for the sheet S or that an improperly gauged sheet thickness is present. In such a situation, which may, for example, be determined after three cycles of the feeling and separating sequence, an all stop condition should be activated by the control.

When during this process the feeler gauge assembly 502 signals that only a single sheet S is present, then the remaining sequences of transfer to the machine tool 10 can be activated by the controller 30.

It will be appreciated that although a mechanical feeler has been described thus far, other designs of feeler gauges can be utilized and that, in fact, non-mechanical thickness sensing devices may be employed in place of the mechanical feeler gauge.

Figure 12:
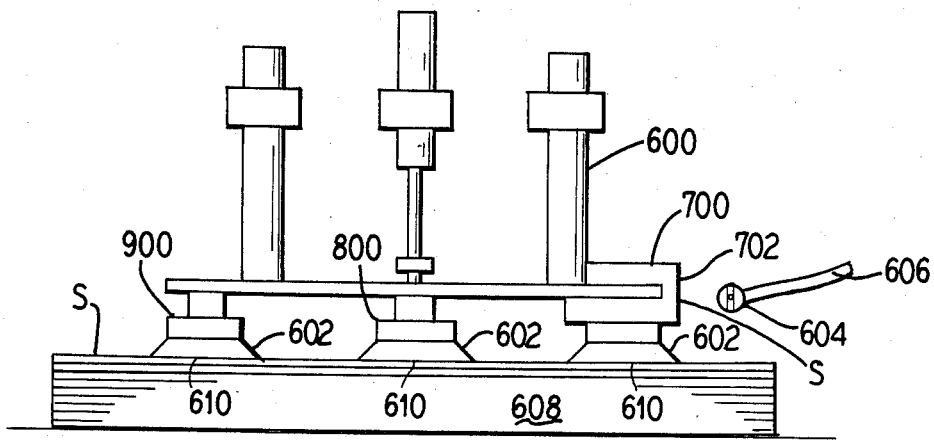
FIG. 12 is a side elevational view of another embodiment of a sheet separator device according to this invention including a stack of similar sheets.

FIG. 12 shows a preferred embodiment of the present sheet separating device having a head portion 600 with a plurality of suction cups 602 depending therefrom, which head portion 600 and suction cup 602 are substantially similar to the head 101 and suction cups 110 of the previously described embodiment. Three groups, 700, 800, and 900, of cup sets are shown in FIG. 12, although a different number of groups may also be used. The embodiment shown in FIG. 12 differs from the previously described embodiment in that the end most group 700 of cup sets includes cup assemblies 702 which are vertically movable with respect to the head 600 while the groups 800 and 900 are stationary with respect to the head 600.

Figure 15:
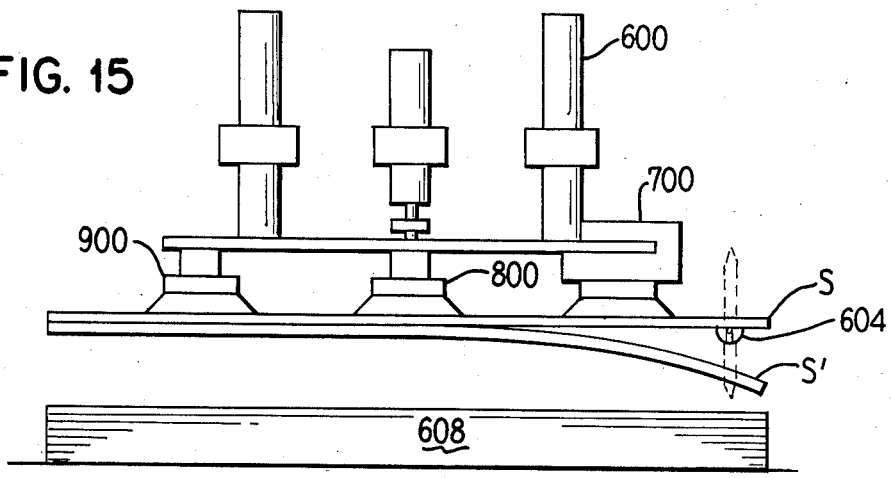
FIG. 15 is a view similar to that of FIG. 14 showing propagation of a gap between a top sheet and underlying sheets.
Figure 16:
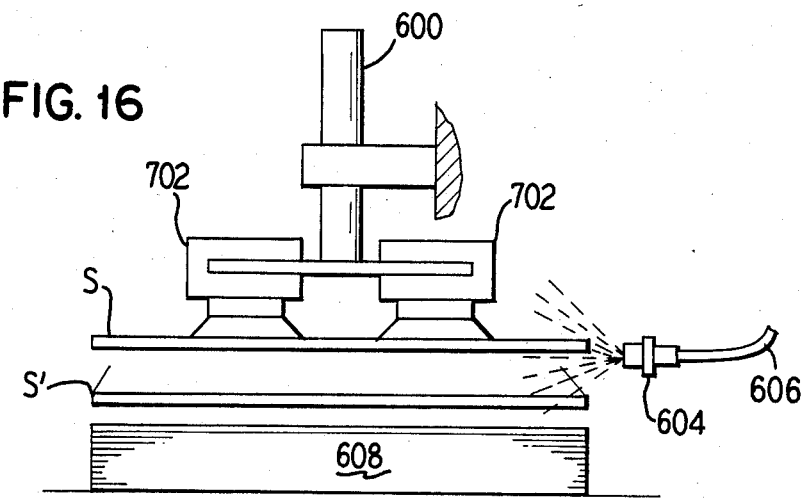
FIG. 16 is an end elevational view from the right of FIG. 15 showing more clearly the relationship between an air jet and the sheets.

An air jet nozzle 604 is also included that is connected to a pneumatic conduit 606 and positioned to direct a blast of air toward flexed portions of the sheets S, as will be described more fully in conjunction with FIGS. 15 and 16.

Figure 13:
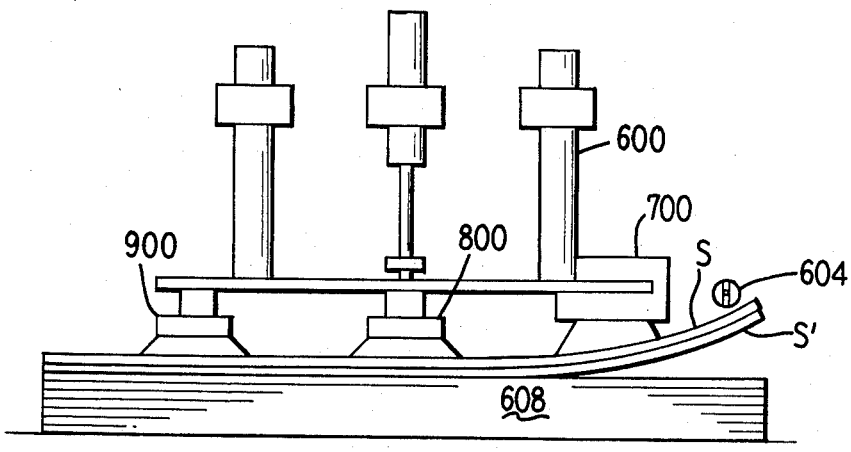
FIG. 13 is a view similar to that of FIG. 12 showing flexure of a plurality of sheets by the present device.

Head 600 is shown in FIG. 12 lowered onto a stack 608, similar to the stack 67 of FIG. 2, where the application of suction to the suction cup 602 causes a top sheet S to be gripped by surface engaging faces 610 on the cups 602. The suction cup subassemblies 702 are mounted on the head 600 at each suction cup 602 of the group 700. The subassemblies 702 of the preferred embodiment are movable between first and second positions where the first position is substantially in a plane containing the groups 800 and 900 and the second position is above the plane containing the groups 800 and 900. FIG. 13 shows the subassemblies 702 moved to their second upper positions by the action of pneumatic conduits (not shown). The movement of the subassemblies upward flexes an edge most portion of the top sheet S and any underlying sheets S' adhering to the top sheet. The action of flexing an edge portion of the sheet S upward while the sheet S is still on the stack 608 causes many underlying sheets S' to loosen their adhesion to the top sheet S.

Figure 14:
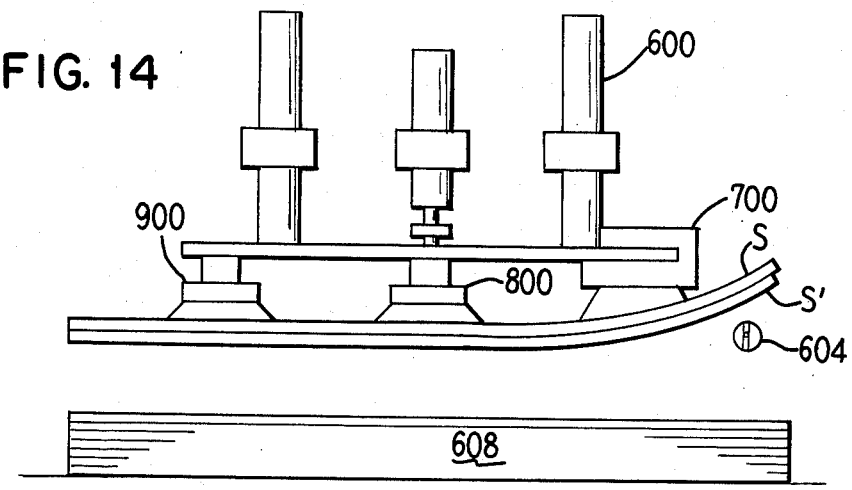
FIG. 14 is a view similar to that of FIG. 13 showing lifting of a plurality of sheets from a stack of similar sheets.

After flexing an edge portion of the top sheet S upward, the head 600 is raised upwardly from the stack 608 as shown in FIG. 14. Lifting of the top sheet S from the stack 608 enables many underlying sheets S' which were loosened by the flexing motion, to separate from the top sheet S and fall back onto the stack 608.

The air blast from the air jet nozzle 604 is started, if it is not already on, and the cup subassemblies 702 are moved to their first positions in the plane of the other groups 800 and 900. The air jet nozzle 604 is positioned to direct a blast of air toward a flexed edge of the top sheet S. In the preferred embodiment, the blast of air is directed to impinge a side of the flexed sheet S and is shaped in a vertically oriented flattened fan shape so that the air blows both above and below the sheet S as the sheet S is straightened from the flexed shape. Straightening the sheet S from its flexed position initiates a gap between the top sheet S and any adhering sheets S', and the air blast propagates the gap so that the adhesion between the top sheet S and adhering sheets S' is removed. The adhering sheet or sheets S' thus fall to the stack 608 and the separated top sheet S is then transported to the machine tool 10.

The feeler gauge 502, discussed in conjunction with FIGS. 7–9, may also be used with the preferred embodiment. After movement of the cup subassemblies 702 back to the first position, the feeler gauge 502 is moved to measure the thickness of the sheets S being held by the present device and determine whether more than one sheet is present. If the top sheet S has been successfully separated from the underlying sheets S', as determined by the feeler gauge 502, the destacker unloader device 50 feeds the sheet S to the machine tool 10. If, however, more than one sheet is sensed by the feeler 502, the subassembly 702 is again activated to flex the edge portion upward and then flex it downward while a blast of air is directed toward the flexed portion. Thereafter, the feeler gauge measures the sheet S to determine whether the second flexing operation has been successful. This may continue, as discussed above, until the underlying sheets S' are loosened from the top sheet S or until it is determined that there is an error in the setting of the thickness gauge 502 or that the adhering sheets S' will not loosen.

It will therefore be appreciated that this invention describes an improved sheet material de-stacker and loader device 50 which is equipped with a sheet separation mechanism and method for separating undesired adhered sheets S' which may adhere to the undersurface of a destacked sheet S. We have also shown a sensing system which may be employed with the sheet separating system for the purpose of fully automated operation insuring that undesired adhered sheets S are separated.

Although the teachings of our invention have herein been discussed with reference to specific theories and embodiments, it is to be understood that these are by way of illustration only and that others may wish to utilize our invention in different designs or applications. For example, different groups of suction cup subassemblies, or even different suction cups within a single suction cup group, may be moved so that the top sheet is flexed to loosen adhering sheets. In other designs, all of the cups could move and portions of the top sheet would be prevented from movement by contact with stationary non-cup devices. Further, although we have described a method which stops movement of the head during the sheet reciprocation cycle, it is possible to activate that cycle during head movement. It is also forseen to use a variety of shaped air blasts directed toward various portions of the sheet to propagate gaps and aid separation of the sheets.

We claim:

1. A sheet de-stacker and separator for separating sheet material, one sheet at a time, from a stack of sheet material, and transporting the separated sheet to a sheet utilizing machine tool mechanism which comprises: a member movable towards and away from the top of the stack of sheet material and means for moving said member, a plurality of suction cup devices having stack engageable faces carried by said member and means for applying suction to said cup devices, each of said cup devices including at least one suction cup operatively mounted to said member by means for providing relative movability between said suction cup and said member including a pneumatic cylinder housing containing a pneumatic cylinder, a piston mounted for movement in said pneumatic cylinder, a power arm connected to said piston and extending from said pneumatic cylinder, said power arm connected to one of said member and said at least one suction cup, a vertically disposed guide rod slidably mounted to another one of said member and said at least one suction cup, and means for causing such relative movement, said means for causing such relative movement effective to cause said at least one suction cup to undergo reciprocatory movements towards and away from the top of said stack and including a pneumatic operating system connected to said pneumatic cylinder, others of said plurality of suction cup devices being carried by said member in relatively fixed position, said at least one suction cup having a neutral position with respect to said member, said neutral position causing said at least one suction cup to have a stack engageable face thereof lying on a plane with stack engageable faces of the other of said suction cup.

2. The method of destacking and separating sheets of material from a stack of such sheets which comprises the steps of: providing a member movable towards and away from a top of said stack and providing means to move said member, affixing a plurality of suction cup devices to said member, said suction cup devices having sheet engagable surfaces, providing means for applying a suction to said suction cup devices, positioning the member over the stack, moving the member towards the stack until said surfaces of said suction cup devices engage a top sheet of said stack, supplying suction to said suction cup devices and thereafter moving said member away from said stack to move at least a top sheet of a stack of sheets away from said stack by adherence of said top sheet to said surfaces by reason of said suction, thereafter causing at least one of said suction cup devices to undergo relative vertical movement with respect to others of said suction cup devices to cause said top sheet to undergo a bending movement, and repeating the relative movement of the at least one of said suction cups.

3. A sheet de-stacking and transport device for separating large sheets of material, one at a time, from a stack of said sheets, and transporting the separated sheet to a machine tool and releasing the transported sheet to the machine tool, which comprises: a frame, a transfer carriage supported by said frame, a sheet stack area, a machine tool deposit area, said carriage movable between said sheet stack area and said deposit area, said carriage carrying a head member, power means for moving said head member in a generally vertical direction towards and away from a top of a stack of sheets received in said stack area, a plurality of suction cup assemblies carried by said head member and each having sheet engaging surfaces, said plurality including a first group and a second group, said first group being vertically reciprocatable with respect to said second group, means for reciprocating said first group, said means for reciprocating including means for maintaining the suction cups of said first group at a chosen one of three different positions and for moving the suction cups of said first group between said three positions, said suction cups having sheet engaging surfaces, a first of said three positions positioning the sheet engaging surfaces of the suction cups of said first group below sheet engaging surfaces of the suction cups of said second group, a second of said three positions positioning the sheet engaging surfaces of the suction cups of said first group at a position above the sheet engaging surfaces of the suction cups of said second group and a third of said positions positioning the sheet engaging surfaces of the suction cups of said first group on a common plane with the sheet engaging surfaces of the suction cups of said second group.

4. The device of claim 3, wherein the means for causing movement between said three positions comprises pneumatic cylinder means connecting the suction cups of said first group to said head, said pneumatic cylinder means includes first and second cylinders having respectively first and second pistons therein with said first and second cylinders affixed together by means for preventing relative movement between said first and second cylinders, means for causing selective movement of each of said pistons, power arms affixed to each of said pistons projecting respectively from opposite ends of said first and second cylinders, said power arm of said piston of one of said cylinders being operatively affixed to said head and said power arm of the other of said cylinders being operatively affixed to said suction cups of said first group.

5. The device of claim 4, including means carried by said frame for detecting the presence of a plurality of sheets carried by said suction cups when said head is elevated to a position where said suction cups are vertically spaced from a top of a stack of sheets received in said area, said detecting means including a stationary upper finger for engaging a top surface of a sheet carried by said suction cups, a lower finger vertically movable against a lower surface of sheets carried by said suction cups, and linear position sensing means for monitoring the position of said lower finger.

6. The method of separating sheets one at a time from a stack of sheets and transporting the separated sheet to a machine tool which comprises the steps of providing a lateral transfer carriage, providing a vertically movable head assembly affixed to said transport carriage with a plurality of suction cup assemblies carried by said head assembly and means to selectively provide suction force to said suction cups, providing means to move said head assembly vertically with respect to said carriage, providing means to move a portion of said suction cups vertically with respect to others of said suction cups independent of movement of the head, positioning said carriage over a stack of worksheets, descending said head until said suction cups contact a top sheet of said stack of sheets, providing suction to said suction cups, moving said head away from said stack to a first position substantially vertically above said stack, vertically reciprocating a said portion of said suction cups with respect to said other of said suction cups when said head is at said first position to separate underlying sheets which may adhere to the sheet grasped by said suction cups, terminating said reciprocation, activating said carriage to transport a sheet carried by said suction cups to said machine tool.

7. The method of claim 6, including the steps of: reciprocating said portion of said suction cups when said head is at said first position between first, second and third positions of said portions of said suction cups, the first position being a position where sheet engaging surfaces of said a portion of said suction cups are positioned above sheet engaging surfaces of the other of said suction cups, a second position where said sheet engaging surfaces of said a portion of said suction cups is coplanar with sheet engaging surfaces of the said others of said suction cups and a third position where the sheet engaging surfaces of said portion of said suction cups is at a position below the sheet engaging surfaces of the other of said suction cups whereby a sheet carried by said suction cups will be caused to undergo bowing movements which are both upwardly and downwardly from a neutral plane position.

8. The method of claim 6, including the steps of sensing the presence of a plurality of sheets carried by said suction cups when said head is at said first position.

9. The method of claim 1, including the step of outputting a signal from said sensing to repeat said reciprocatory movement.

10. A sheet de-stacking and transport device for separating large sheets of material, one at a time, from a stack of such sheets and transporting the separated sheet to a machine tool and releasing the transported sheet to the machine tool, which comprises:

a stack receiving area, a lifting and transporting device having a first member movable towards and away from said area in a substantially vertical direction and power means to cause said movement, a head assembly mounted to said first member, at least three suction cup assemblies having sheet engaging faces, first means operatively affixing middle ones of said suction cup assemblies to said head assembly, second means operatively affixing opposite end ones of said cup assemblies to said head member, said first means being vertically movable with respect to said second means and including first and second pneumatic cylinders connected back to back to one another, a first piston movably mounted in said first pneumatic cylinder, a second piston movably mounted in said second pneumatic cylinder for movement substantially parallel with the movement of said first piston, a first power arm extending from said first pneumatic cylinder and connected between said first piston and said head assembly, a second power arm extending from said second pneumatic cylinder and connected between said second piston and said middle ones of said suction cup assemblies, guide means connected to said middle ones of said suction cup assemblies and slidably connected to said first and second pneumatic cylinders and to said head assembly, whereby a sheet engaged by said suction cup assemblies has a midportion flexed downwardly relative to opposite ends of said sheet when said first and second pistons are at mutually opposed positions in said first and second cylinders, the midportion of the sheet is flexed upwardly with reference to its ends when said first and second pistons are in mutually adjacent positions in said first and second cylinders, and the sheet midportion being coplanar with its ends when one of said first and second pistons is in an opposed position and the other piston is in an adjacent position, a pneumatic drive selectively connectable to said first pneumatic cylinder and to said second pneumatic cylinder to move said first and second pistons between the opposed positions and the adjacent positions.

11. A method of separating sheets of workpiece material from a stack of such sheets which comprises the steps of:

(a) applying an attractive force to a top surface of a top sheet of said stack by a device suspended above the stack, (b) moving the device substantially vertically away from the stack while maintaining the force and thereby lifting at least the top sheet above the stack, (c) causing first portions of the lifted top sheet to undergo vertical reciprocatory movement between first, second, and third positions with respect to second portions of said top sheet to cause any adhering underlying sheets to separate from said top sheet and to fall by gravity onto said stack, said first position being above said second portions, said second position being copolanar with said second portions, and said third position being below said second portions, (d) thereafter terminating said reciprocating movement, and (e) utilizing the separated top sheet in a machine tool.

12. The method of claim 11, including the steps of (f) terminating the substantially vertical movement of the device at a first position, (g) providing a sheet thickness sensor adjacent the first position, (h) sensing the thickness of the workpiece material suspended from the device at the first position, (i) outputting a signal from said sensor and in response to said signal selectively repeating step (c) or performing step (e).

13. The method of claim 12, including the steps of (j) applying the attractive force of step (a) to at least three separated areas of said top sheet, one of said areas being at said first portions of step (c) and other of said areas being at said second portions, the one of said areas being intermediate the other of said areas.

14. The method of claim 13, including the steps of:

(k) repeating steps (h) and (i) after step (d) and before step (e) if step (c) has been selectively repeated.

15. A device for separating sheets one at a time from a stack of sheets, comprising:

means for applying an attractive force to a top surface of a top sheet of the stack substantially along a common plane, said force applying means including groups of suction cup assemblies mounted to a head, means associated with said force applying means for flexing an end portion of said top sheet, said flexing means including a first group of suction cup assemblies having at least two vertically displaced positions and a pneumatic cylinder and piston connected between said first group and said head for movement between said two positions, said pneumatic cylinder end piston being disposed laterally of said first group of suction cup assemblies, and means associated with said force applying means for lifting said head to separate the top sheet from the stack.

16. A sheet separating device as claimed in claim 15, further comprising:

an air jet impinging an edge of said top sheet during flexing by said flexing means, said air jet having a fan shape with a major axis substantially in the direction of flexing by said flexing means so that air from said air jet simultaneously flows over and under said top sheet during flexing.

17. A sheet separating device as claimed in claim 15, further comprising:

a thickness sensing means for detecting the presence of more than one sheet being lifted from the stack, said thickness sensing means including a sensing head having a first stationary finger and a second vertically movable finger, a roller provided on at least said first finger, means for moving said second finger vertically against said first finger, position sensing means for detecting the position of said second finger relative to said first finger, said position sensing means including:

an abutment block mounted for movement with said second finger;

a vertically movable arm biased to abut said abutment block; and means for monitoring the vertical position of said arm, means for moving said sensing head horizontally toward and away from an edge of the top sheet when lifted from said stack.

18. A sheet separating device as claimed in claim 15 wherein:

said flexing means flexes an edge portion of said top sheet between first and second positions, said first position being vertically displaced away from the stack and said second position being substantially in said common plane.

19. A method of separating sheets one at a time from a stack of sheets comprising:

applying an attractive force to a top surface of a top sheet of the stack substantially along a common plane, flexing an edge portion of said top sheet upwardly with respect to the stack, lifting said flexed top sheet and any sheets adhering thereto from the stack, directing a stream of air at a lateral edge of said flexed edge portion, returning said flexed edge portion to the common plane while said air is being directed thereat whereby the steps of flexing an edge portion, directing a stream of air at the flexed portion and returning said flexed portion to a plane causes sheets adhering to said top sheet to separate therefrom.

20. A method as claimed in claim 19, further comprising:

sensing the thickness of said lifted sheets, determining whether more than one sheet is among said lifted sheets, selectively repeating the steps of flexing the edge portion of said top sheet upwardly when more than one sheet is determined to be among said lifted sheets, again directing a stream of air at a lateral edge of said flexed portion, and returning said flexed portion to said common plane while said stream of air is being directed thereat.

21. A sheet separating apparatus for lifting and transporting sheets one at a time from a stack of similar sheets, comprising:

a head assembly positionable over the stack and vertically movable toward and away from a top of the stack, a plurality of groups of suction cups carried by said head assembly, said groups of suction cups having sheet engaging faces for engaging and holding a sheet, means for vertically moving a first of said groups relative to others of said groups, said moving means having at least two positions wherein a first position is substantially in a plane common to others of said groups and a second position is displaced vertically from said others of said groups away from said stack whereby vertical movement of said first group flexes a portion of a sheet held by said groups of suction cups, and means for directing a shaped jet of air toward a lateral edge of said flexed portion of said sheet, said shaped jet of air having a flattened fan shape substantially perpendicular to the common plane of said suction cup groups.

22. A sheet separating apparatus as claimed in claim 21 further comprising:

a thickness sensor selectively engageable with a sheet held by said groups of suction cups for detecting the presence of a plurality of sheets carried by said groups of suction cups.

23. A sheet separating device as claimed in claim 21 wherein said vertically moving means flexes an edgemost portion of a sheet held by said groups of suction cups.

24. A sheet separating apparatus for lifting and transporting sheets one at a time from a stack of similar sheets, comprising:

a head assembly positionable over the stack and vertically movable toward and away from a top of the stack, a plurality of suction cup groups carried at spaced locations along said head assembly, said suction cup groups having sheet engaging faces disposed generally in a plane for engaging and holding a top sheet from the stack of similar sheets, a first one of said suction cup groups including suction cups that are vertically movable with respect to said head, others of said suction groups fixed with respect to said head assembly, said vertically movable suction cups including pneumatic cylinders and pistons operatively connected between said suction cups and said head assembly, said pneumatic cylinders and pistons controllable to cause said suction cups to move between a first position and a second position, said first position causing said first suction cup group to lie generally in said plane, said first suction cup group being an endmost group, said movable suction cups including guide rods and bushings slidably mounted between said head assembly and said suction cups, and an air nozzle connected to direct a stream of air toward a flexed lateral edge of a sheet being held by said suction cup groups so that said stream of air flows over and under said flexed lateral edge.

* * * * *

UNITED STATES PATENT AND TRADEMARK OFFICE

CERTIFICATE OF CORRECTION

PATENT NO. : 4,703,925

DATED : November 3, 1987

INVENTOR(S) : Ross R. Jelinek et al.

It is certified that error appears in the above—identified patent and that said Letters Patent is hereby corrected as shown below:

At column 7, line 5, please replace "FIG. 1" with --FIG. 2--.

At column 7, line 31, please replace "carrier" with --carriage--.

At column 8, line 64, please insert --30-- after "control".

At column 15, line 26, please replace "cup" with --cups--.

Signed and Sealed this

Second Day of June, 1992

*Attest:*

DOUGLAS B. COMER

*Attesting Officer*

*Acting Commissioner of Patents and Trademarks*